US009932836B2

(12) United States Patent
Schnieder et al.

(10) Patent No.: US 9,932,836 B2
(45) Date of Patent: Apr. 3, 2018

(54) TURBINE BLADE

(71) Applicant: ANSALDO ENERGIA IP UK LIMITED, London (GB)

(72) Inventors: Martin Schnieder, Ennetbaden (CH); Sergey Shchukin, Mellingen (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 573 days.

(21) Appl. No.: 14/490,813

(22) Filed: Sep. 19, 2014

(65) Prior Publication Data

US 2015/0004001 A1 Jan. 1, 2015

Related U.S. Application Data

(63) Continuation of application No. PCT/EP2013/055965, filed on Mar. 21, 2013.

(30) Foreign Application Priority Data

Mar. 22, 2012 (EP) ..... 12160893

(51) Int. Cl.
*F01D 5/18* (2006.01)

(52) U.S. Cl.
CPC ..... *F01D 5/186* (2013.01); *F01D 5/187* (2013.01); *F05C 2251/02* (2013.01); *F05D 2250/71* (2013.01); *F05D 2300/501* (2013.01)

(58) Field of Classification Search
CPC . F01D 5/18; F01D 5/186; F01D 5/187; F05D 2250/71; F05D 2300/501; F05D 2240/30
See application file for complete search history.

(56) References Cited

U.S. PATENT DOCUMENTS 3,191,908 A * 6/1965 Petrie ..... F01D 5/187 416/96 R
5,073,083 A * 12/1991 Guyon ..... F01D 5/186 415/115

(Continued)

FOREIGN PATENT DOCUMENTS

EP 0 447 320 A1 9/1991
EP 0 806 546 A1 11/1997

(Continued)

OTHER PUBLICATIONS

Office Action (Notification of Reasons for Refusal) dated Jan. 10, 2017, by the Japanese Patent Office in corresponding Japanese Patent Application No. 2015-500931 and an English Translation of the Office Action. (13 pages).

*Primary Examiner* — Jason Shanske
*Assistant Examiner* — Christopher R Legendre
(74) *Attorney, Agent, or Firm* — Buchanan Ingersoll & Rooney PC

(57) ABSTRACT

A turbine vane for a rotary turbomachine has a turbine blade delimited by a concave pressure-side wall and a convex suction-side wall which are connected in the region of a vane front edge which can be assigned to the turbine blade and enclose a cavity which extends in the longitudinal extent of the vane front edge and is delimited on the inner wall by the pressure-side wall and the suction-side wall in the region of the vane front edge and by an intermediate wall which extends in the longitudinal direction to the vane front edge and connects the suction-side wall and the pressure-side wall on the inner wall. The intermediate wall has a perforation at least in sections in the connecting region to the suction-side wall and/or pressure-side wall, in order to increase the elasticity of the intermediate wall.

19 Claims, 3 Drawing Sheets

(56) References Cited

U.S. PATENT DOCUMENTS 5,246,340 A * 9/1993 Winstanley ..... B23P 15/04 415/115
5,342,172 A * 8/1994 Coudray ..... F01D 5/186 416/95
5,382,133 A * 1/1995 Moore ..... F01D 5/186 415/115
5,688,104 A 11/1997 Beabout
5,690,472 A * 11/1997 Lee ..... F01D 5/187 416/95
5,813,835 A * 9/1998 Corsmeier ..... F01D 5/186 415/115
5,827,045 A * 10/1998 Beeck ..... F01D 5/284 416/224
6,099,251 A * 8/2000 LaFleur ..... F01D 5/147 415/115
6,290,463 B1 * 9/2001 Fargher ..... F01D 5/187 415/115
6,609,884 B2 * 8/2003 Harvey ..... F01D 5/187 415/115
6,732,502 B2 * 5/2004 Seda ..... F01D 5/03 60/226.1
7,374,403 B2 * 5/2008 Decker ..... F01D 5/141 416/223 A
7,520,725 B1 4/2009 Liang
7,534,089 B2 * 5/2009 Liang ..... F01D 5/186 415/115
7,625,180 B1 * 12/2009 Liang ..... F01D 5/186 29/889.2
8,152,468 B2 * 4/2012 Propheter-Hinckley ..... F01D 5/189 416/96 A
8,231,349 B2 * 7/2012 Naik ..... F01D 5/186 416/97 R
8,448,895 B2 * 5/2013 Suciu ..... B64D 27/26 244/53 R
8,523,523 B2 * 9/2013 Townes ..... F01D 5/187 416/90 R
8,678,743 B1 * 3/2014 Sheridan ..... F02C 7/36 415/1
8,807,477 B2 * 8/2014 Suciu ..... B64D 27/26 244/53 R
8,844,265 B2 * 9/2014 Adams ..... F02C 7/36 415/199.4
8,961,111 B2 * 2/2015 Benson ..... F01D 5/187 415/1
9,296,039 B2 * 3/2016 Propheter-Hinckley .. B22C 9/10
2001/0016162 A1 8/2001 Lutum et al.
2004/0096313 A1 5/2004 Harvey et al.
2005/0265840 A1 12/2005 Levine et al.
2008/0056888 A1 * 3/2008 Somanath ..... F01D 5/147 415/142
2009/0074575 A1 3/2009 Propheter-Hinckley et al.
2010/0162683 A1 * 7/2010 Grabowski ..... F02C 7/36 60/226.3
2010/0303635 A1 * 12/2010 Townes ..... F01D 5/187 416/97 R
2012/0198816 A1 * 8/2012 Suciu ..... B64D 27/26 60/226.3
2012/0233982 A1 * 9/2012 Suciu ..... B64D 27/26 60/226.3
2013/0192256 A1 * 8/2013 Suciu ..... F02K 3/06 60/796
2015/0004001 A1 * 1/2015 Schnieder ..... F01D 5/186 416/97 R
2016/0090847 A1 * 3/2016 Shchukin ..... F01D 5/187 416/96 R

FOREIGN PATENT DOCUMENTS

EP 1 319 803 A2 6/2003
EP 1 605 138 A2 12/2005
EP 2 107 215 A1 10/2009
EP 2 228 517 A2 9/2010
JP S59-200001 A 11/1984
JP 2002242607 8/2002

* cited by examiner

TURBINE BLADE

CROSS-REFERENCE TO RELATED APPLICATIONS

This application claims priority to PCT/EP2013/055965 filed Mar. 21, 2013, which claims priority to European application 12160893.9 filed Mar. 22, 2012, both of which are hereby incorporated in their entireties.

TECHNICAL FIELD

The disclosure relates to a turbine blade for a rotating turbomachine, having a blade airfoil which is bounded by a concave pressure side wall and a convex suction side wall which enclose a cavity which is delimited by the pressure side wall and suction side wall and by an intermediate wall which extends in the longitudinal direction and connects the suction side wall and pressure side wall internally.

BACKGROUND

Turbine blades of the abovementioned generic type are heat-resistant components which are used in particular in turbine stages of gas turbine arrangements and, in the form of guide blades or rotor blades, are exposed to the hot gases directly leaving the combustion chamber.

The heat resistance of such turbine blades comes, on one hand, from the use of heat-resistant materials and, on the other hand, from a highly efficient cooling of the turbine blades which are directly exposed to the hot gases and which, in order that a coolant, preferably cooling air, can continuously flow through and act on them, have corresponding cavities that are connected to a coolant supply system of the gas turbine arrangement, which coolant supply system provides cooling air for the purpose of cooling all of the gas turbine components which are exposed to heat, i.e. in particular the turbine blades, when the gas turbine is in operation.

Conventional turbine blades have a blade root to which the blade airfoil is connected directly or indirectly in the radial direction, which airfoil has a concave-shaped pressure side wall and a convex-shaped suction side wall which are integrally connected in the region of the blade leading edge and between which is bounded an interspace that, for cooling purposes, is supplied with cooling air from the direction of the blade root. In this context, the term "in the radial direction" signifies the turbine blade extent in the mounted state in the gas turbine arrangement, which is oriented radially with respect to the axis of rotation of the rotor unit. In order to undertake the supply and distribution of cooling air in the interspace enclosed between the suction side wall and the pressure side wall, for an optimized cooling of the turbine blade, the interspace is provided with intermediate walls which run in the radial direction and which in each case separate cavities that are oriented radially inside the blade airfoil, some of which have fluidic connections. At suitable positions along the cavities, throughflow openings are provided in the suction side wall or the pressure side wall, in the region of the turbine blade leading edge and/or trailing edge or at the turbine blade tip, such that the cooling air can escape outward into the hot gas duct of the turbine stage.

A gas turbine blade which has been optimized with respect to cooling purposes is known from EP 1 319 803 A2, which provides for a multiplicity of radially oriented cooling duct cavities inside the turbine blade airfoil which are in each case fluidically connected in meandrous fashion and through which more or less cooling air flows depending on the thermal load on the various blade airfoil regions. It is particularly expedient to provide particularly efficient cooling for the region of the blade leading edge, which experiences the greatest flow exposure and heat exposure to the hot gases. To that end, a cavity extends internally in the longitudinal direction with respect to the blade leading edge, which cavity is delimited by the suction side and pressure side which unite at the blade leading edge and by an intermediate wall which connects the suction side and pressure side with one another internally, this cavity being supplied with cooling air from the direction of the blade root. The cooling air flowing through the cavity usually leaves in the region of the blade airfoil tip. Furthermore, in order to improve the transfer of heat between the blade airfoil wall and the cooling air flowing through the cavity, structures that swirl the cooling air flow are provided along the wall regions which enclose the cavity.

A further preferred cooling of the blade leading edge region of a turbine blade is described in U.S. Pat. No. 5,688,104. Along the blade leading edge there runs a cavity which, on one hand, is bounded by the suction side wall and pressure side wall which unite at the blade leading edge, and by an intermediate wall which rigidly connects the suction side wall and pressure side wall to one another inside the blade airfoil. The cavity running along the blade leading edge is supplied with cooling air which enters the cavity only through cooling duct openings provided in the intermediate wall. The straight intermediate wall is provided, in its radial longitudinal extent, with a multiplicity of individual throughflow ducts through which cooling air from an adjacent radial cooling duct enters the aforementioned cavity along the blade airfoil, in the direction of the blade leading edge, in the manner of an impingement cooling. In order to evacuate the cooling air introduced into the cavity, film cooling openings are provided along the blade leading edge, respectively oriented toward the suction side outer wall and pressure side outer wall, through which openings the cooling air introduced into the cavity is expelled, forming a film cooling respectively on the pressure side outer wall and suction side outer wall.

In order to improve the cooling effect, especially of the blade leading edge of a turbine blade, it is appropriate with the known cooling techniques to, on one hand, increase the supply of cooling air and, on the other hand, optimize the cooling mechanisms of the impingement cooling.

Turbine blades which, for the purpose of an optimized heat resistance in particular in the region of the blade leading edge, have the abovementioned cooling measures nonetheless often exhibit, in the blade leading edge region along the pressure side wall and suction side wall, fatigue symptoms which, in the final stages, become apparent by the formation of cracks. The reason for such crack formation lies in the apparition of thermomechanical stresses, within the suction side wall and pressure side wall in the blade leading edge region, which stem from large temperature differences between the blade leading edge exposed to the hot gases and the inner wall regions of the blade airfoil which are acted upon by the cooling air. In particular in the case of transient operating states of the gas turbine arrangement, such as those which arise in the turbine stage during startup or changes in load, temperature differences of approximately 1000° C. may occur between the blade leading edge exposed to the hot gases and the intermediate wall and inner wall sections which are acted upon by the cooling air. It is obvious that such great temperature differences give rise, within the suction side wall and pressure side wall along the blade leading edge, to considerable thermomechanical stresses which lead to considerable material loads, as mentioned above.

SUMMARY

The disclosure is based on the object of developing a turbine blade for a rotating turbomachine, having a blade airfoil which is bounded by a concave pressure side wall and a convex suction side wall which are connected in the region of a blade leading edge which can be assigned to the blade airfoil, and which enclose a cavity which extends in the longitudinal extent of the blade leading edge and is delimited internally by the pressure side wall and suction side wall in the region of the blade leading edge and by an intermediate wall which extends in the longitudinal direction to the blade leading edge and connects the suction side wall and pressure side wall internally, such that the fatigue symptoms in the region of the blade leading edge, which are induced by temperature differences, are reduced or even entirely avoided, in order thus to improve the lifespan of the turbine blades exposed to great heat.

The measures required for this should, as far as possible, not impair the cooling measures known per se but should furthermore improve and support these. In addition, the measures required for this should neither be cost-intensive nor require great production-related expenditure.

A turbine blade according to the solution for a rotating turbomachine has a blade airfoil which is bounded by a concave pressure side wall and a convex suction side wall which are connected in the region of a blade leading edge which can be assigned to the blade airfoil, and which enclose a cavity which extends in the longitudinal extent of the blade leading edge and is delimited internally by the pressure side wall and suction side wall in the region of the blade leading edge and by an intermediate wall which extends in the longitudinal direction to the blade leading edge and connects the suction side wall and pressure side wall internally. This intermediate wall, as well as the suction side wall and/or pressure side wall, are one continuous piece. This is typically produced as a casting. The disclosed turbine blade is noteworthy in that the intermediate wall has, at least in sections, a perforation in the connection region to the suction side wall and/or pressure side wall in order to increase the elasticity. In this context, a perforation is to be understood as a multiplicity of holes. These are typically arranged along a line. Typically, this line is straight, at least in sections. For example, three or more holes may be arranged along a straight line. In particular, this increases the elasticity of the intermediate wall. By virtue of the elastic connection region, the intermediate wall has less of a stiffening effect on the entire blade, such that the distortions between the pressure side wall and suction side wall are also reduced. That region of the intermediate wall which adjoins the suction side wall and/or pressure side wall is here identified as the connection region of the intermediate wall to the suction side wall and/or pressure side wall. The connection region may extend as far as one quarter of the distance between the suction side wall and pressure side wall. The connection region typically extends over a distance smaller than the thickness of the intermediate wall or smaller than between one times and two times the thickness of the intermediate wall. According to one embodiment, the connection region is limited to a rounding or fillet in the transition from the intermediate wall to the suction side wall and/or pressure side wall. According to a further embodiment, the connection region is limited to a region starting from the side wall which corresponds to twice the radius of the rounding or fillet in the transition from the intermediate wall to the suction side wall and/or pressure side wall.

The disclosure is based on the knowledge that the formation of fatigue cracks in the blade leading edge region of turbine blades exposed to hot gases predominantly originate in the fact that the thermally induced expansion and contraction tendency of the pressure side wall region and suction side wall region in the blade leading edge region mechanically counteracts the inflexibility of the rigidly formed intermediate wall around which cooling air is constantly flowing, which is arranged behind the blade leading edge immediately inside the blade airfoil and which securely connects the suction side wall and pressure side wall with one another, as a consequence of which the greatly heated and heat-exposed suction side wall region and pressure side wall region experience an increased internal mechanical stress which in turn creates a high material load, ultimately leading to the fatigue symptoms which reduce the lifespan. In order to counter the mechanical constraint which gives rise to the fatigue symptoms and acts on the pressure side wall region and suction side wall region along the blade leading edge, the intermediate wall which is arranged immediately behind the blade leading edge and which, together with the internal walls of the pressure side wall and suction side wall, delimits the cavity running along the blade leading edge is modified, according to the solution, such that the intermediate wall or, respectively, the connection region of the intermediate wall experiences an elasticity by means of which the thermally induced expansion and contraction tendency of the suction side wall region and pressure side wall region along the blade leading edge can be at least partially restored. To that end, the intermediate wall has, in a departure from the conventional rigid wall connection between the intermediate wall and the suction side wall and pressure side wall, at least at a connection region to the side wall a perforation by means of which the above-described elasticity can be produced.

According to one embodiment, the perforation comprises a row of cylindrical holes. According to a further embodiment, the perforation comprises a row of longitudinal holes or slits, the longer side of which extends parallel to the respective adjacent suction side wall or pressure side wall.

The connection of the intermediate wall to the side wall, forms relatively thick accumulations of material, the surface-to-volume ratio of which is much smaller than in a free wall section. In addition, the flow of the walls is prevented on the internal side by the connection, such that, in the event of transient changes in the hot gas temperature or cooling air temperature, the temperature of the blade material in the connection region changes more slowly than the material temperatures in a free wall section. This leads to additional heat stresses which are reduced by means of the perforation.

The connection region of the intermediate wall to the suction side wall and/or pressure side wall is in fact typically formed with a rounding or fillet. In the case of cast blades, this fillet results from production. On one hand, it reduces stress concentrations at the wall connection, on the other hand it further increases the accumulations of material in the connection region of the intermediate wall to the suction side wall and/or pressure side wall. The perforation in the connection region improves the heat transfer on the inside of the walls, such that transient temperature changes can be better followed. In order to further counteract the effect of the accumulation of material, and improve the heat transfer in the connection region, according to one embodiment the perforation runs at least in part through the fillet.

In one preferred embodiment of the turbine blade, the intermediate wall has, extending from the suction side wall to the pressure side wall or vice versa, at least one curved wall section which deviates from a straight wall profile. This curvature increases the elasticity so as to give, in particular in combination with the perforated connection region of the intermediate wall, a flexible intermediate wall.

In one preferred embodiment, the intermediate wall which directly faces the blade leading edge and connects the suction side internal wall and pressure side internal wall to one another has a V-shaped or U-shaped wall cross section which preferably extends over the entire radial length of the intermediate wall. Such a curvature, according to the solution, of the intermediate wall, the profile of which extends from the suction side wall to the pressure side wall or vice versa and permits in just this spatial direction a curvature-induced wall elasticity, makes it possible, in the event of a thermally induced expansion of the suction side wall and pressure side wall in the blade leading edge region, to conform to the tendency of the suction side wall and pressure side wall to move apart from one another by elastic stretching of the curved intermediate wall.

In the opposite case of a thermally induced contraction of the material, which leads to a reduction in the mutual separation between the pressure side wall and suction side wall in the blade leading edge region, the curved intermediate wall is able to follow the reducing wall distance by increasing the curvature of the wall.

According to a further embodiment, the turbine blade has, at the base of the V-shaped or U-shaped cross section of the intermediate wall, at least in sections, a perforation which runs parallel to the perforation in the connection region in order to increase elasticity. Overall, there thus results for the intermediate wall a hinge-like structure, between the two legs of the V-shaped or U-shaped cross section, which allows a rotational movement of the legs about the perforations, and thus provides for compensation for changes in the mutual separation between the pressure side wall and suction side wall.

As a consequence of the abovementioned flexibility of the intermediate wall, the mutual separation between the pressure side wall and suction side wall in the blade leading edge region can be set depending on the temperature without damaging mechanical stresses arising within the pressure side wall and suction side wall, in particular in the connection region to the internal intermediate wall.

It is of course conceivable for the respective intermediate wall to be formed with curved wall contours which deviate from the "V" or "U" wall cross section shape. Thus, for example, intermediate walls formed in a wave-like or concertina-like shape in cross section are possible. However, all of such wall sections to be formed according to the solution share the fact that they have a curvature-induced wall elasticity and are flexibly connected to the outer walls by means of the perforation.

In order to further improve the wall elasticity, a preferred embodiment provides for forming the intermediate wall, at least in certain portions, with a thickness which is equal to or preferably less than the thicknesses of the suction side wall and pressure side wall in the blade leading edge region. The intermediate wall need not necessarily have a constant thickness over its entire wall cross section. It is thus possible for the intermediate wall thickness, elasticity of the perforated connection region and the curvature behavior of the intermediate wall to be optimized in relation to one another so as to achieve a particularly suitable wall elasticity. If particularly high wall elasticities are to be produced, particularly suitable are wall sections along the intermediate wall which are highly curved and/or are chosen to be suitably thin.

The measure according to the solution for an intermediate wall having a perforated connection region is also not necessarily limited to the intermediate wall which immediately faces the blade leading edge. It is of course possible, in a manner according to the solution, to also produce other intermediate walls, provided within the blade profile, which have a perforation or which have a perforation and are curved, in order to give way, stress-free, to thermally induced contraction or expansion effects affecting the pressure side wall and suction side wall.

It has proven particularly advantageous for the V-shaped or U-shaped wall curvature of the intermediate wall which directly faces the blade leading edge to be formed and arranged such that the convex wall side of the V-shaped or U-shaped wall section faces the region of the blade leading edge.

It is further advantageous to form that curvature contour of the intermediate wall which extends from the suction side wall to the pressure side wall or in the opposite direction in such a way that that convex wall side of the intermediate wall which faces the blade leading edge is formed and arranged substantially parallel to the suction side wall and pressure side wall bounding the cavity and connected at the blade leading edge. Such a configuration is particularly advantageous especially when producing what is referred to as an impingement cooling, as will be shown by the further explanations with reference to an exemplary embodiment relating thereto. It is thus possible to orient, in a targeted manner, impingement cooling air flows toward specific internal wall regions in the blade leading edge region by means of throughflow ducts respectively created within the intermediate wall. In this manner, temperature-induced material stresses may be effectively counteracted by means of an optimized cooling of the blade leading edge region.

In order to achieve sufficient flexibility, according to one exemplary embodiment a row of holes is considered to be a perforation in which, in the perforation direction, the proportion of the hole lengths represents at least 30% of the overall length of the perforated region. For the sake of high flexibility, according to another exemplary embodiment the proportion of the hole lengths represents at least 50% of the overall length of the perforated region. This is brought about e.g. by means of a row of cylindrical bores which are respectively separated by twice their diameter. In particular in the case of embodiments having longitudinal holes or slits, a proportion of the hole lengths may exceed 70% of the overall length of the perforated region.

The connection region of the intermediate wall to the pressure side wall or suction side wall respectively comprises for example up to 20% of the wall distance between the two side walls. The connection region typically extends one or two times the thickness of the intermediate wall in the connection direction of the intermediate wall.

BRIEF DESCRIPTION OF THE DRAWINGS

Preferred embodiments of the disclosure will be described below with reference to the drawings which serve purely for illustrative purposes and are not to be interpreted as limiting, and in which.

DETAILED DESCRIPTION

Figure 1:
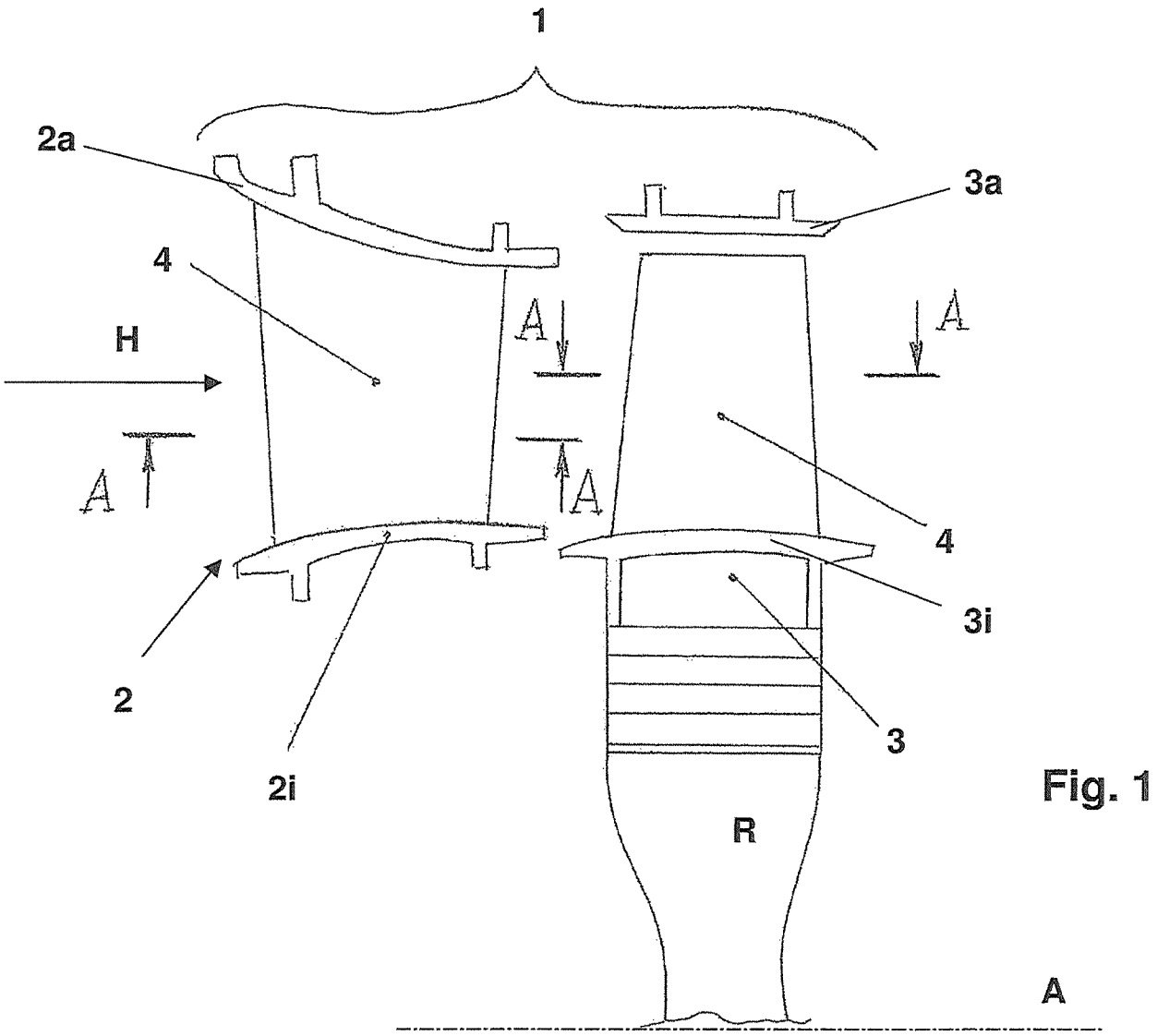
FIG. 1 is an illustration of the schematic arrangement of turbine guide blades and turbine rotor blades within a turbine stage.

FIG. 1 shows, in a schematic representation, a guide blade 2 and a rotor blade 3 as they are arranged in a turbine stage (not illustrated in more detail) along a guide blade row and rotor blade row. It should be assumed that the guide blade 2 and the rotor blade 3 come into contact with a hot gas stream H which, in the illustration, flows from left to right over the respective blade airfoils 4 of the guide blade 2 and the rotor blade 3. The blade airfoils 4 of the guide blade 2 and rotor blade 3 project into the hot gas duct of the turbine stage 1 of a gas turbine arrangement, which hot gas duct is respectively bounded by radially inner shrouds 2*i*, 3*i* and by the radially outer shrouds 2*a* of the guide blades 2 and radially outer heat accumulation segments 3*a*. The rotor blade 3 is mounted on a rotor unit R (not shown in more detail) which is mounted such that it is able to rotate about an axis of rotation A.

Figure 2:
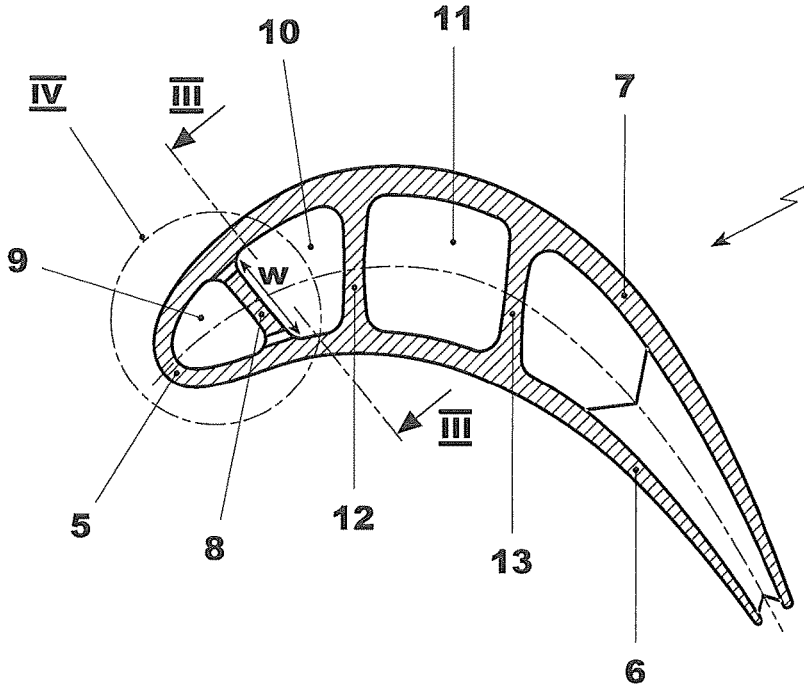
FIG. 2 shows a representative profile through a turbine blade and FIGS. 3*a, b, c* show alternative variants for forming a perforation in an intermediate wall in the region of the blade leading edge.

FIG. 2 shows a cross-sectional representation through a guide blade or rotor blade which results along a plane of section A-A shown in FIG. 1. The typical blade profile of a turbine guide blade or turbine rotor blade is distinguished by an aerodynamically profiled blade airfoil 4 which is delimited on its two sides by a convex suction side wall 7 and by a concave pressure side wall 6. The convex suction side wall 7 and the concave pressure side wall 6 unite in one piece in the region of the blade leading edge 5 which, as already explained in the introduction, is directly exposed to the hot gas stream passing through the turbine stage of a gas turbine arrangement. It is obvious that the turbine blade region along the blade leading edge 5 experiences a particularly high thermal load.

In order to cool the turbine blade exposed to the hot gases, radially oriented cavities 9, 10, 11 etc., which are flooded with cooling air, are provided within the blade airfoil 4. The individual cavities 9, 10, 11 etc. are separated from one another by intermediate walls 8, 12, 13 etc. Depending on the form and configuration of the turbine blade, the individual cooling ducts 9, 10, 11 etc. communicate with one another.

In order to solve the problem, noted in the introduction, of fatigue-induced crack formation in the suction side wall 7 and pressure side wall 6 close to the blade leading edge 5, the foremost intermediate wall 8 in the connection region to the suction side wall 7 and/or pressure side wall 6 is provided, at least in sections, with a perforation 16. Exemplary embodiments of perforations 16 are shown in FIGS. 3*a, b* and *c*.

Figure 3A:
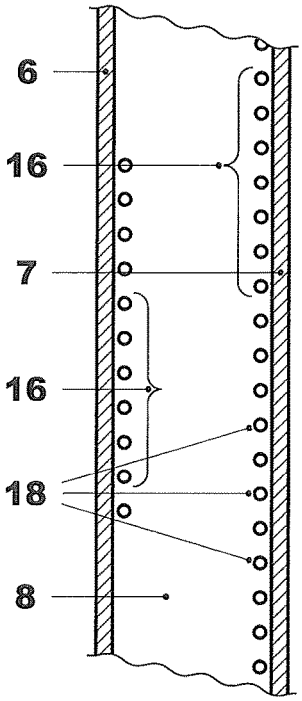

A first exemplary embodiment is shown in FIG. 3*a*. One perforation 16 is provided in each connection region of the intermediate wall 8 to the suction side wall 7 and pressure side wall 6. The perforations of the example shown are a row of cylindrical holes 18 which are arranged parallel to the suction side wall 7 and pressure side wall 6. In the example, the perforation 16 at the pressure side wall 6 runs only over a section of the intermediate wall 8.

Figure 3B:
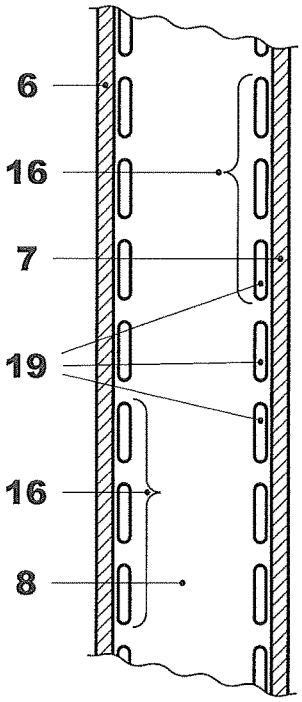

A second exemplary embodiment is shown in FIG. 3*b*. One perforation 16 is provided in each connection region of the intermediate wall 8 to the suction side wall 7 and pressure side wall 6. The perforations of this example are a row of longitudinal holes 19 which are arranged parallel to the suction side wall 7 and pressure side wall 6 and whose longer side extends parallel to the respective adjacent suction side wall 7 or pressure side wall 6.

Figure 3C:
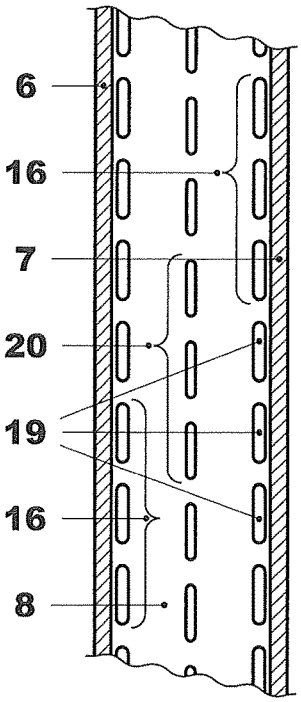

In the third exemplary embodiment of FIG. 3*c*, in addition to the perforation 16 of the example shown in FIG. 3*b*, a central perforation 20 is also provided, which runs parallel to the suction side wall 7 and pressure side wall 6 in the center of the intermediate wall 8. Together with the perforations 16 in the connection region to the suction side wall 7 and pressure side wall 6, this forms an intermediate wall 8 which is divided in two and can be flexibly folded together.

Figure 4A:
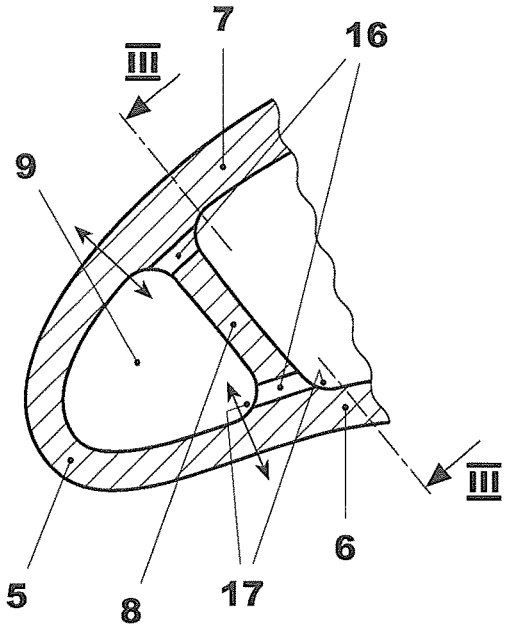
FIG. 4*a-d* show alternative variants for forming an intermediate wall in the region of the blade leading edge.

In order to better illustrate the intermediate wall configuration, reference is made to the exemplary embodiment illustrated in detail in FIG. 4*a*, which shows the blade profile in the blade leading edge region. FIG. 4*a* shows a perforation 16 in the connection region of the suction side wall 7 and in the connection region of the pressure side wall 6. In the example, the principal direction of the tendency of the material of the side walls 6, 7 to expand or contract runs substantially parallel to the extent of the intermediate wall 8.

Figure 4B:
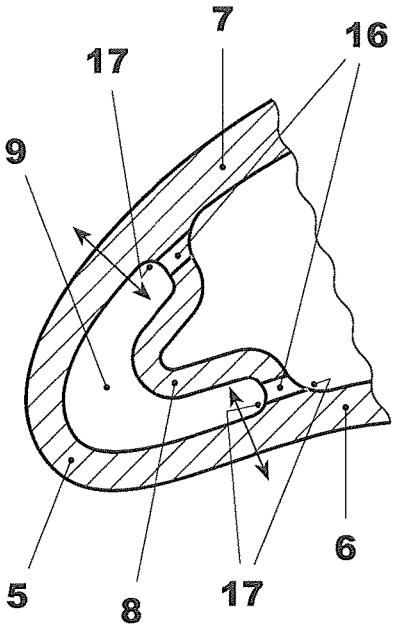

In contrast to a straight configuration, as is the case in FIGS. 1, 2, 3 and 4*a* with the intermediate walls 8, 12, 13, FIG. 4*b* shows an exemplary embodiment with a curved intermediate wall 8. The intermediate wall 8 has a U-shaped wall cross section which is integrally connected internally on both sides both to the suction side wall 7 and to the pressure side wall 6. The U-shaped wall configuration of the intermediate wall 8 lends the blade profile region an additional elastic deformability such that it is possible to yield to the thermally induced tendency of the material of the suction side wall and pressure side wall to expand or contract, in that the wall distance W is not fixed as hitherto but is variable within certain limits which are determined by the shape and curvature elasticity of the intermediate wall 8 and the elasticity of the perforation 16.

Figure 4C:
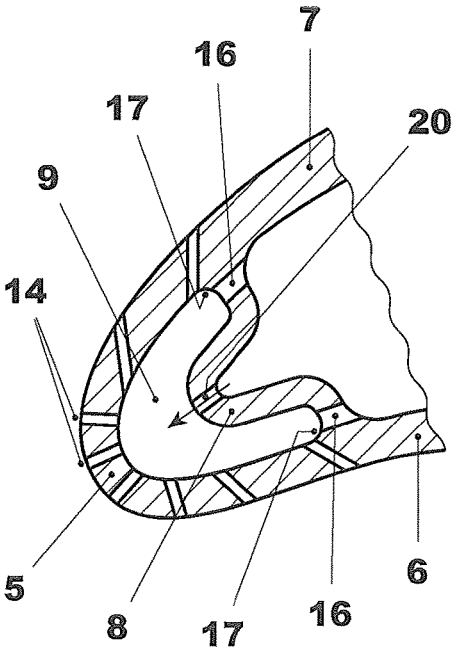

FIG. 4*c* shows, in detail, an exemplary embodiment having an additional central perforation 20. This divides the intermediate wall 8 into two legs which, proceeding from the connection region to the side walls 6, 7, run at an angle toward each other, it being possible for the angle to be flexibly changed by means of the central perforation 20, making it easy to compensate for expansion-induced changes in the separation between the pressure side wall and suction side wall.

Further, FIG. 4*c* shows an example for a possible film cooling arrangement. Cooling air leaves the cavity 9 via the film cooling holes 14 and forms a film of cooling air on, respectively, the surface of the suction side outer wall 6 and pressure side outer wall 7. The U-shaped intermediate wall 8, which is integrally connected on its two sides with the internal wall of the suction side wall 7 and pressure side wall 6, preferably has a wall profile on the convex side which faces the blade leading edge 5 and is formed substantially parallel to the suction side wall 7 and pressure side wall 6 which bound the cavity 9 and are integrally connected at the blade leading edge 5. In this example, the cooling air enters the forward cavity 9 at least partially through the perforations 16 and central perforation 20.

Figure 4D:
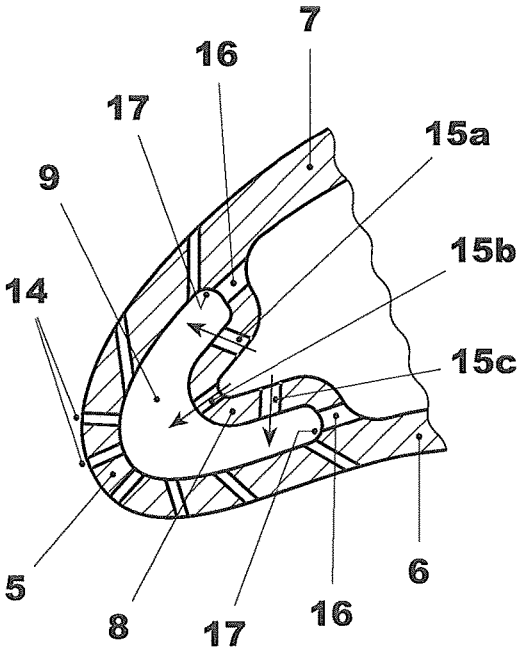

A further exemplary embodiment having details for the cooling is shown in FIG. 4*d*. Here, the intermediate wall has perforations 16 at the connection regions to the suction side wall 7 and pressure side wall 6. It also has, next to the perforation, cooling air throughflow ducts 15*a, b, c* which serve for the impingement cooling of the internal wall side 17 of the blade wall leading edge. Particularly advantageously, the throughflow ducts 15*a, b, c* can be split into at least three groups depending on their throughflow duct longitudinal extent and the throughflow direction which is predetermined thereby.

A first group of throughflow ducts 15*a* is distinguished by a throughflow direction which is oriented toward the suction side wall 7, a second group of throughflow ducts 15*b* is distinguished by a throughflow direction which is oriented toward the blade leading edge and a third group of throughflow ducts 15*c* is distinguished by a throughflow direction which is oriented toward the pressure side wall 6. The throughflow ducts 15*a*, 15*b* and 15*c* are distributed along the entire radial extent in the intermediate wall 8 and thus provide effective and individual cooling of the blade leading edge region of the turbine blade. Further throughflow ducts may of course be created in the intermediate wall 8 for the purpose of an optimized impingement cooling.

Furthermore, the impingement air cooling may be combined with a central perforation. Impingement air cooling air holes typically have a larger diameter than the perforation holes, for example twice as large.

The invention claimed is:

1. A turbine blade for a rotating turbomachine, comprising:

a blade airfoil including a concave pressure side wall and a convex suction side wall connected in a region of a leading edge of the blade airfoil; and a cavity extending in a longitudinal direction of the blade and delimited by the pressure side wall and suction side wall in the region of the leading edge and by an intermediate wall extending in the longitudinal direction of the blade and connecting the suction side wall and pressure side wall internally, wherein the intermediate wall having, at least in sections, a perforation wherein at least one of a connection of the intermediate wall to the suction side wall and a connection of the intermediate wall to the pressure side wall comprises a fillet and each perforation runs at least in part therethrough for increasing an elasticity of the intermediate wall in the connection region, wherein the intermediate wall has, extending from the suction side wall to the pressure side wall or vice versa, at least one curved wall section which deviates from a straight wall profile and the at least one curved wall section is configured to have a curvature-induced elasticity in a direction of the extent of the intermediate wall from the suction side wall to the pressure side wall or vice versa, the at least one curved wall section is V-shaped or U-shaped as seen in a cross section cutting through the leading edge, and a convex wall side of the at least one V-shaped or U-shaped wall section is formed and arranged substantially parallel to the suction side wall and pressure side wall which are connected at the blade leading edge and which bound the cavity.

2. The turbine blade as claimed in claim 1, wherein each perforation comprises a row of cylindrical holes.

3. The turbine blade as claimed in claim 1, wherein each perforation comprises a row of longitudinal holes or slits, a longer side of which extends parallel to the adjacent suction side wall and/or pressure side wall.

4. The turbine blade as claimed in claim 1, wherein the intermediate wall has a wall side which faces away from the cavity and which, together with the suction side wall and the pressure side wall, delimits at least one further cavity, and in that the cavities are cooling ducts into which a coolant can be introduced.

5. The turbine blade as claimed in claim 4, wherein openings of each perforation are created parallel to an internal surface of the suction side wall or, respectively, an internal surface of the pressure side wall in each connection region of the intermediate wall and, in operation, cooling air flows through these openings from the cavity into the at least one further cavity and an outlet jet of the respective opening runs tangentially to the internal surface of the respective suction side wall or, respectively, pressure side wall.

6. The turbine blade as claimed in claim 1, wherein at a base of the V-shaped or U-shaped cross section of the intermediate wall there is, at least in sections, a second perforation which runs parallel to each perforation in each connection region in order to increase elasticity.

7. The turbine blade as claimed in claim 1, wherein throughflow ducts are provided in the intermediate wall for impingement cooling of the suction side wall and pressure side wall which are connected at the leading edge.

8. The turbine blade as claimed in claim 1, wherein the turbine blade is a guide blade or a rotor blade of a turbine stage of a gas turbine arrangement.

9. The turbine blade as claimed in claim 1, wherein in a perforated region a hole length of an perforations represents at least 30% of the overall length of the perforated region.

10. A turbine blade for a rotating turbomachine, comprising:

a blade airfoil including a concave pressure side wall and a convex suction side wall connected in a region of a leading edge of the blade airfoil; and a cavity extending in a longitudinal direction of the blade and delimited by the pressure side wall and suction side wall in the region of the leading edge and by an intermediate wall extending in the longitudinal direction of the blade and connecting the suction side wall and pressure side wall internally, wherein the intermediate wall having, at least in sections, a perforation wherein at least one of a connection of the intermediate wall to the suction side wall and a connection of the intermediate wall to the pressure side wall comprises a fillet and each perforation runs at least in part therethrough for increasing an elasticity of the intermediate wall in the connection region, wherein the intermediate wall has, extending from the suction side wall to the pressure side wall or vice versa, at least one curved wall section which deviates from a straight wall profile and the at least one curved wall section is configured to have a curvature-induced elasticity in a direction of the extent of the intermediate wall from the suction side wall to the pressure side wall or vice versa, throughflow ducts are provided in the intermediate wall for impingement cooling of the suction side wall and pressure side wall which are connected at the blade leading edge, and the throughflow ducts arranged in the intermediate wall are split into at least three groups with respect to their throughflow direction which is predetermined by a throughflow duct longitudinal extent which can be assigned to the throughflow ducts, wherein a first group of throughflow ducts having a throughflow direction is oriented toward the suction side wall, a second group of throughflow ducts having a throughflow direction is oriented toward the blade leading edge and a third group of throughflow ducts having a throughflow direction is oriented toward the pressure side wall.

11. The turbine blade as claimed in claim 10, wherein each perforation comprises a row of cylindrical holes.

12. The turbine blade as claimed in claim 10, wherein each perforation comprises a row of longitudinal holes or slits, a longer side of which extends parallel to the adjacent suction side wall and/or pressure side wall.

13. The turbine blade as claimed in claim 10, wherein the intermediate wall has a wall side which faces away from the cavity and which, together with the suction side wall and the pressure side wall, delimits at least one further cavity, and in that the cavities are cooling ducts into which a coolant can be introduced.

14. The turbine blade as claimed in claim 13, wherein openings of each perforation are created parallel to an internal surface of the suction side wall or, respectively, an internal surface of the pressure side wall in each connection region of the intermediate wall and, in operation, cooling air flows through these openings from the cavity into the at least one further cavity and an outlet jet of the respective opening runs tangentially to the internal surface of the respective suction side wall or, respectively, pressure side wall.

15. The turbine blade as claimed in claim 10, wherein the at least one curved wall section is V-shaped or U-shaped as seen in a cross section cutting through the leading edge.

16. The turbine blade as claimed in claim 10, wherein at a base of the V-shaped or U-shaped cross section of the intermediate wall there is, at least in sections, a second perforation which runs parallel to each perforation in each connection region in order to increase elasticity.

17. The turbine blade as claimed in claim 10, wherein the at least one curved wall section is V-shaped or U-shaped as seen in a cross section cutting through the leading edge, and wherein a convex wall side of the at least one V-shaped or U-shaped wall section is formed and arranged substantially parallel to the suction side wall and pressure side wall which are connected at the blade leading edge and which bound the cavity.

18. The turbine blade as claimed in claim 10, wherein the turbine blade is a guide blade or a rotor blade of a turbine stage of a gas turbine arrangement.

19. The turbine blade as claimed in claim 10, wherein in a perforated region a hole length of the perforations represents at least 30% of an overall length of the perforated region.

* * * * *